US006040818A

United States Patent [19]

Minami et al.

[11] Patent Number: 6,040,818

[45] Date of Patent: Mar. 21, 2000

[54] METHOD AND APPARATUS FOR DISPLAYING PIXELS ON A DISPLAY DEVICE

[75] Inventors: Toshiya Minami, Sagamihara; Hiroshi Satoh, Machida; Takanobu Satoh, Yokohama, all of Japan

[73] Assignee: International Business Machines Corporation, Armonk, N.Y.

[21] Appl. No.: 08/274,133

[22] Filed: Jul. 12, 1994

Related U.S. Application Data

[63] Continuation of application No. 07/879,075, May 1, 1992, abandoned, which is a continuation of application No. 07/565,598, Aug. 10, 1990, abandoned.

[30] Foreign Application Priority Data

Nov. 8, 1989 [JP] Japan ..... 1-207040

[51] Int. Cl.[7] ..... G09G 5/10

[52] U.S. Cl. ..... 345/147; 345/114

[58] Field of Search ..... 340/793, 750, 340/703, 701, 791, 784, 765, 767, 812, 813; 358/168, 169; 345/112, 113, 114, 116, 119, 189, 339, 147, 150

[56] References Cited

U.S. PATENT DOCUMENTS

| | | | |
|---|---|---|---|
| 4,520,356 | 5/1985 | O'Keefe et al. . | |
| 4,563,677 | 1/1986 | Seiler . | |
| 4,581,612 | 4/1986 | Jones | 340/791 |
| 4,788,535 | 11/1988 | Chikara et al. | 340/703 |
| 4,791,417 | 12/1988 | Bobak | 340/793 |
| 4,977,398 | 12/1990 | Pleva et al. | 340/793 |

FOREIGN PATENT DOCUMENTS

| | | | |
|---|---|---|---|
| 1200631 | 2/1986 | Canada | 340/703 |
| 0175499 | 8/1985 | European Pat. Off. . | |
| 54-3581 | 2/1979 | Japan . | |

OTHER PUBLICATIONS

Using WordPerfect, 3rd Edition, Beacham et al, 1987, pp 103–107.

Toute l'Electronique, "Simplification de la Monochromes" No. 524, May 1987, Paris France, p. 54, middle column—p. 55 left column, Figures 2, 6, p. 57, right column.

*Primary Examiner*—Chanh Nguyen
*Attorney, Agent, or Firm*—Volel Emile; John G. Graham; Andrew J. Dillon

[57] ABSTRACT

A signal generator responsive to a normal mode signal by generating control signals for displaying low luminance foreground pixels and high luminance background pixels. In addition, the signal generator is responsive to a high intensity mode signal by generating control signals for displaying zero luminance foreground pixels and high luminance background pixels.

24 Claims, 7 Drawing Sheets

| | NEGATIVE DISPLAY MODE | | POSITIVE DISPLAY MODE | |
|---|---|---|---|---|
| | NORMAL MODE | HIGH INTENSITY MODE | NORMAL MODE | HIGH INTENSITY MODE |
| OUTPUT A | 71A<br>1 1 1 1 1<br>0 0 1 0 0<br>0 0 1 0 0<br>0 0 1 0 0<br>0 0 1 0 0<br>0 0 1 0 0<br>0 0 1 0 0 | 72A<br>1 1 1 1 1<br>0 0 1 0 0<br>0 0 1 0 0<br>0 0 1 0 0<br>0 0 1 0 0<br>0 0 1 0 0<br>0 0 1 0 0 | 73A<br>1 1 1 1 1<br>0 0 1 0 0<br>0 0 1 0 0<br>0 0 1 0 0<br>0 0 1 0 0<br>0 0 1 0 0<br>0 0 1 0 0 | 74A<br>1 1 1 1 1<br>0 0 1 0 0<br>0 0 1 0 0<br>0 0 1 0 0<br>0 0 1 0 0<br>0 0 1 0 0<br>0 0 1 0 0 |
| OUTPUT A' | 71A'<br>1 1 1 1 1<br>0 0 1 0 0<br>0 0 1 0 0<br>0 0 1 0 0<br>0 0 1 0 0<br>0 0 1 0 0<br>0 0 1 0 0 | 72A'<br>1 1 1 1 1<br>0 0 1 0 0<br>0 0 1 0 0<br>0 0 1 0 0<br>0 0 1 0 0<br>0 0 1 0 0<br>0 0 1 0 0 | 73A'<br>0 0 0 0 0<br>1 1 0 1 1<br>1 1 0 1 1<br>1 1 0 1 1<br>1 1 0 1 1<br>1 1 0 1 1<br>1 1 0 1 1 | 74A'<br>0 0 0 0 0<br>1 1 0 1 1<br>1 1 0 1 1<br>1 1 0 1 1<br>1 1 0 1 1<br>1 1 0 1 1<br>1 1 0 1 1 |
| OUTPUT B | 71B<br>1 1 1 1 1<br>0 0 1 0 0<br>0 0 1 0 0<br>0 0 1 0 0<br>0 0 1 0 0<br>0 0 1 0 0<br>0 0 1 0 0 | 72B<br>0 0 0 0 0<br>0 0 0 0 0<br>0 0 0 0 0<br>0 0 0 0 0<br>0 0 0 0 0<br>0 0 0 0 0<br>0 0 0 0 0 | 73B<br>0 0 0 0 0<br>1 1 0 1 1<br>1 1 0 1 1<br>1 1 0 1 1<br>1 1 0 1 1<br>1 1 0 1 1<br>1 1 0 1 1 | 74B<br>0 0 0 0 0<br>0 0 0 0 0<br>0 0 0 0 0<br>0 0 0 0 0<br>0 0 0 0 0<br>0 0 0 0 0<br>0 0 0 0 0 |
| OUTPUT C | 71C<br>0 0 0 0 0<br>0 0 0 0 0<br>0 0 0 0 0<br>0 0 0 0 0<br>0 0 0 0 0<br>0 0 0 0 0<br>0 0 0 0 0 | 72C<br>1 1 1 1 1<br>0 0 1 0 0<br>0 0 1 0 0<br>0 0 1 0 0<br>0 0 1 0 0<br>0 0 1 0 0<br>0 0 1 0 0 | 73C<br>0 0 0 0 0<br>0 0 0 0 0<br>0 0 0 0 0<br>0 0 0 0 0<br>0 0 0 0 0<br>0 0 0 0 0<br>0 0 0 0 0 | 74C<br>0 0 0 0 0<br>1 1 0 1 1<br>1 1 0 1 1<br>1 1 0 1 1<br>1 1 0 1 1<br>1 1 0 1 1<br>1 1 0 1 1 |

FIG. 2

PRIOR ART

@ Card Games #

1. @ Black Jack
2. @ Poker
3. @ Napoleon

Input number you want to play· @_#

METHOD AND APPARATUS FOR DISPLAYING PIXELS ON A DISPLAY DEVICE

This is a continuation of application Ser. No. 07/879,075 filed May 1, 1992 now abandoned, which is a continuation of Ser. No. 07/565,598 filed Aug. 10, 1990, now abandoned.

TECHNICAL FIELD

The present invention generally relates to a display device wherein foreground pixels are displayed by a dark or low luminance level and background pixels are displayed by a high luminance level.

BACKGROUND ART

Display devices are known wherein characters, cursor, lines, etc. are displayed by illuminated pixels (also known as dots, pels or picture elements) with a black or non-illuminated background on a display screen. The display operations for displaying characters, cursor, etc. by the illuminated pixels on a black background will be referred to as a negative display mode or a white on black mode. The negative display mode includes a normal mode and a high intensity mode. In the normal mode characters, cursor, etc. are displayed with low luminance pixels on a black or non-illuminated background. In the high intensity mode the characters, cursor, etc. are displayed with high luminance pixels on a black or non-illuminated background. To control the luminance of a pixel, two binary bits are assigned for each pixel, and represent the luminance of one pixel, as follows:

0 0 . . . Zero luminance (Black)

0 1 . . . Low luminance (Gray)

1 0 . . . High luminance (White)

1 1 . . . Not used

Pixel patterns generated from a font memory include foreground pixels representing the characters to be displayed in combination with background pixels.

Japanese patent application 47-98526 (Published examined patent application No. 54-3581) shows a CRT display device wherein the background is displayed by low luminance, negative value is displayed by zero luminance, and positive value is displayed by high luminance. As a result, the negative and positive values in an equation are distinguishably displayed on the display screen. The application 47-98526, however, does not disclose the concept of the invention.

DISCLOSURE OF THE INVENTION

The present invention provides a signal generating means responsive to a normal mode signal by generating control signals for displaying low luminance foreground pixels and high luminance background pixels. In addition, the signal generating means is responsive to a high intensity mode signal by generating control signals for displaying zero luminance foreground pixels and high luminance background pixels.

In the present invention, the signal generating means first receives a pixel pattern wherein the foreground pixels are represented by a first binary number and the background pixels are represented by a second binary number. The signal generating means then responds to a normal mode signal by generating control signals for displaying low luminance or gray level foreground pixels and high luminance or white level background pixels. The signal generating means also responds to a high intensity mode signal by generating control signals for displaying zero luminance or black level foreground pixels and high luminance or white level background pixels. The characters of the normal mode of the positive display mode and the characters of the high intensity mode of the positive display mode may be simultaneously displayed on the display screen.

The invention solves the problem of prior art display devices. That is, the illegibility of the screen and the fatigue of the eyes of the operator when both the normal and high intensity modes of the positive display mode are simultaneously displayed on the screen.

BRIEF DESCRIPTION OF THE DRAWING

The foregoing and other objects, aspects and advantages of the invention will be better understood from the following Best Mode for Carrying Out the Invention with reference to the figures listed below, in which:

FIG. 2 shows various pixel patterns at various points of the circuit shown in FIG. 1;

BEST MODE FOR CARRYING OUT THE INVENTION

Figure 1:
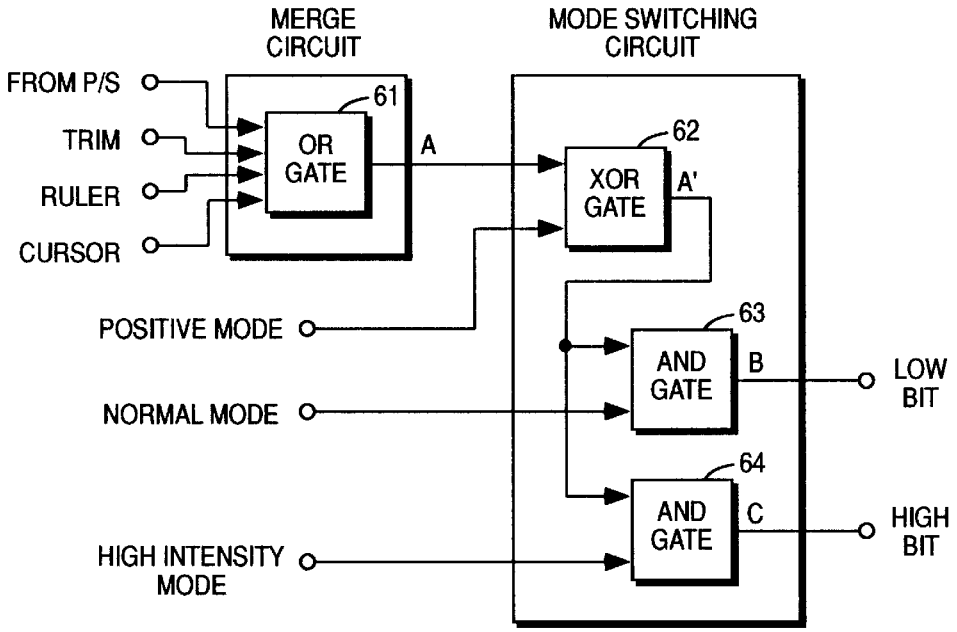
FIG. 1 PRIOR ART
FIG. 1 shows a prior art mode switching circuit.

FIG. 1 shows a merge circuit and a mode switching circuit for generating the two binary bits for each pixel. The pixel patterns generated from the font memory are merged with a trim line, a ruler or a cursor by OR gate 61 in the merge circuit. For illustrative purposes, it is assumed that a character T is displayed in the normal mode of the negative display mode. It is also assumed that no additional functions (i.e., trim, ruler and cursor) are used and that a character is represented by 5 pixels×7 pixels. In the negative display mode, a positive mode signal to an exclusive OR (XOR) gate 62 is at a low level, a normal mode signal to an AND gate 63 is at a high level, and a high intensity mode signal to an AND gate 64 is at a low level. The resulting output pixel patterns at the outputs A, A', B and C are shown in FIG. 2. The two bits on the output lines C and B are used as the two binary bits for controlling luminance of each foreground and background pixel.

The bit on line C is a high order bit and the bit on the line B is a low order bit. Referring to the pixel patterns 71C and 71B generated in this mode, the high order bit for each pixel of the foreground image portion of the character T is 0 and the low order bit for each pixel of the foreground image is 1. In addition, the high order bit for each pixel of the background portion is 0 and the low order bit for each pixel of the background portion is 0.

Therefore, in the normal mode of the negative display mode, the two bit combination (0 1) is assigned to each pixel of the foreground character image and the two bit combination (0 0) is assigned to each pixel of the background. As a result, the foreground image is represented by low luminance or gray level pixels, and the background is represented by non-illuminated or black level pixels.

In the negative display mode, it is often necessary to display the foreground image with the high intensity mode in addition to the normal mode. In the high intensity mode, the positive mode signal is low level, the normal mode signal is low level and the high intensity mode signal is high level. FIG. 2 shows the resulting pixel patterns 72A, 72A', 72B and 72C at the outputs A, A', B and C of FIG. 1. In the high intensity mode of the negative display mode, the two bit combination (1 0) is assigned to each pixel of the foreground character image, and the two bit combination (0 0) is assigned to each pixel of the background. As a result, the foreground character image is represented by high luminance or white level pixels, and the background is represented by non-illuminated or black level pixels.

Recently, it has been necessary to display the characters, cursors, etc. in the positive display mode or black on white mode wherein the characters or the foreground image are represented by non-illuminated pixels and the background is represented by illuminated pixels. To perform the positive display mode, the Exclusive OR gate 62 is added into the mode switching circuit and the positive mode signal is applied to the Exclusive OR gate 62.

The positive display mode also includes a normal mode and a high intensity mode. In the normal mode of the positive display mode, the positive mode signal and the normal mode signal are at a high level, and the high intensity mode signal is at a low level. FIG. 2 shows the resulting pixel patterns 73A, 73A', 73B and 73C at the outputs A, A', B and C of FIG. 1. In the normal mode, the two bit combination (0 0) is assigned to each pixel of the foreground character image, and the two bit combination (0 1) is assigned to each pixel of the background. As a result, the foreground character image T is represented by non-illuminated or black level pixels, and the background is represented by low luminance or gray level pixels.

In the high intensity mode, the positive mode signal and the high intensity mode signal are at a high level and the normal mode signal is at a low level. FIG. 2 shows the resulting pixel patterns 74A, 74A', 74B and 74C at the outputs A, A', B and C of FIG. 1. In this high intensity mode of the positive display mode, the two bit combination (0 0) from the patterns 74C and 74B is assigned to each pixel of the foreground character image, and the two bit combination (1 0) from the pattern 74C and 74B is assigned to each pixel of the background. As a result, the foreground character image T is represented by non-illuminated or black level pixels and the background is represented by high luminance or white level pixels.

Figure 3:
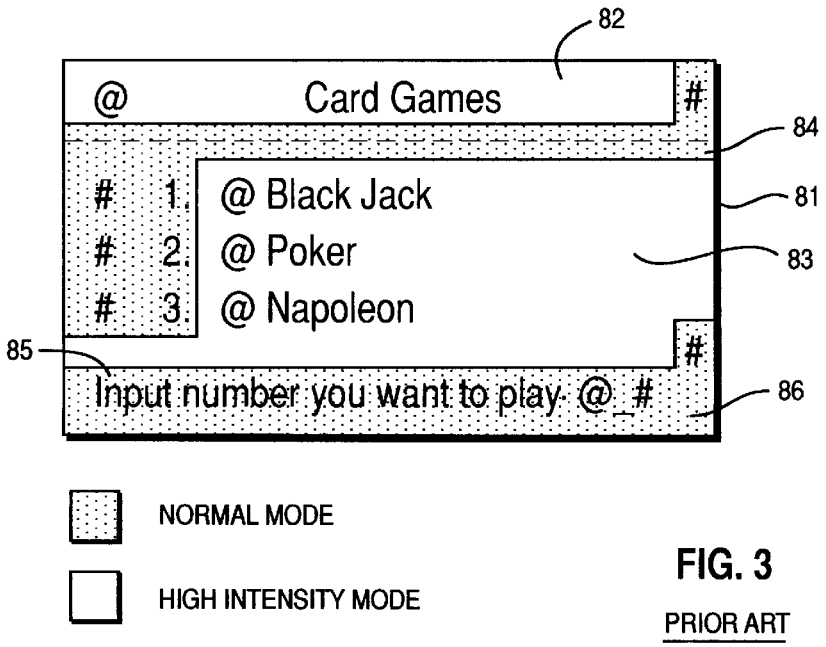
FIG. 3 PRIOR ART
FIG. 3 shows images displayed by the circuit of FIG. 2.

The problem in the positive display mode is that the luminance of the background in the normal mode is the low luminance or gray level specified by the two bit combination (0 1), while the luminance of the background in the high intensity mode is the high luminance or white level specified by the two bit combination (1 0). Thus, in the case that both the normal mode and high intensity mode are simultaneously displayed on a display screen 81, as shown in FIG. 3, the background is displayed by the two kinds of luminance (i.e., the low luminance or gray level and the high luminance or white level). For example, areas 82 and 83 of the high intensity mode have a high luminance background, while the areas 84, 85 and 86 of the normal mode have a low luminance background. The mixed display of these areas on the display screen is often illegible, and causes an asthenopia or fatigue of the operator's eyes.

As shown in FIG. 3, the mark # is a field attribute representing the normal mode, and the mark @ is a field attribute representing the high intensity mode. It is noted that both the marks # and @ are actually not displayed on the display screen. The field attribute is placed at the top of a field including plural character boxes, and defines the attribute characteristics of the field.

One reason for the background luminance changing in the positive display mode is a basic concept from the negative display mode. The luminance of the pixels represented by the binary number 1 of the pixel pattern of the output A' in the FIG. 1 is changed between the two luminance levels. That is, in accordance with the concept of the negative display mode, the foreground pixels represented by the binary number 1 in the positive display mode correspond to the background pixels as shown in the pixel patterns 73A' and 74A' in FIG. 2. In addition, the luminance of the background pixels represented by the binary number 1 are switched between the low luminance (0 1) in the normal mode and the high luminance (1 0) in the high intensity mode.

Figure 4:
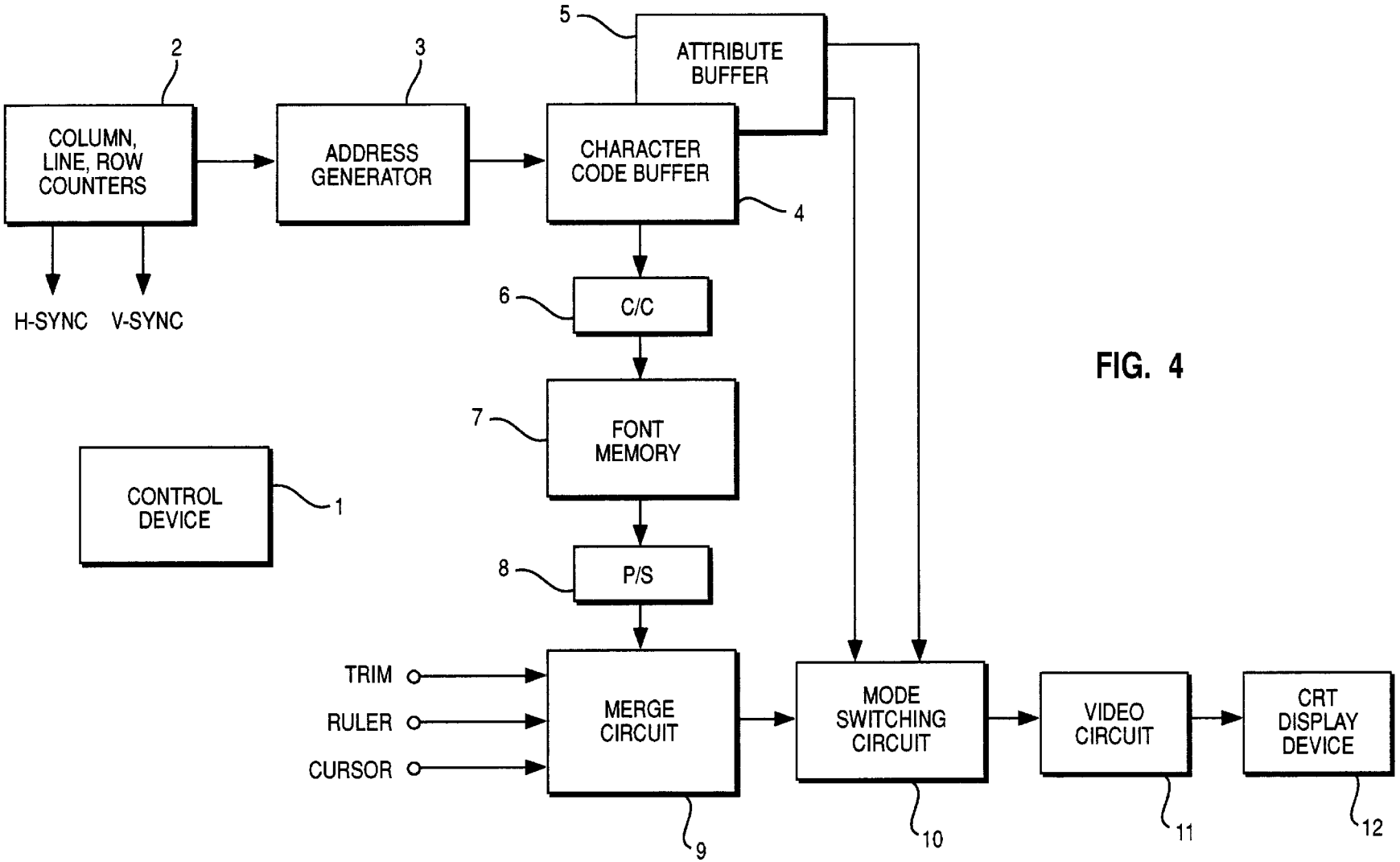
FIG. 4 is a circuit diagram of a display device incorporating a mode switching circuit.

FIG. 4 shows a circuit diagram of a display device or terminal incorporating a mode switching function in accordance with the present invention. A control device 1, such as a microprocessor, controls the operations of the blocks shown in FIG. 4. In practice, a large number of control lines for controlling the operations of the blocks are connected between control device 1 and the blocks. However, for simplifying the drawing, the control lines are not shown.

The circuit includes a column, line, row counter 2, an address generator 3, a character code buffer 4, an attribute buffer 5, a character code register (C/C) 6, a font memory 7, a parallel/serial converter 8, a merge circuit 9, a signal generating circuit or a mode switching circuit 10, a video circuit 11, and CRT display device 12. The operations of many of these blocks are well known in the art and are easily explained.

The character codes and the attributes of the characters displayed on CRT display device 12 are stored in character code buffer 4 and attribute buffer 5 under the control of control device 1. The display screen of CRT display device 12 is divided into plural character boxes, such as 80 (horizontal)×32 (vertical). That is, 32 character rows, each of which includes 80 character boxes or columns, are displayed on the display screen. For example, each character box includes 9×19 pixels or picture elements, and one character in the box is represented by 5×7 pixels. The positions of the character boxes in the horizontal and vertical directions are represented by columns and rows. One row includes 19 scan lines in this example. Scan lines are traced in accordance with a raster scan scheme.

Column, line, row counter 2 counts the number of columns, lines, rows in order to control the display of the characters on display device 12. The count values from column, line, row counter 2 are supplied to address generator 3, which generates addresses for sequentially accessing both character code and attribute buffers 4 and 5. The character codes of the characters of one row are stored in character code register 6 for repeatedly accessing the character pixel patterns in font memory 7, whereby the pixel patterns on one scan line of the character patterns in one row are supplied, in parallel, to parallel/serial converter 8. Converter 8 serially supplies the pixel patterns of plural characters on one scan line to merge circuit 9. In merge circuit 9 a trim line, a ruler line or a cursor is added to the pixel pattern of selected character boxes. The pixel patterns from merge circuit 9 are supplied to signal generating circuit or mode switching circuit 10. The attribute representing the normal mode or the high intensity mode is also supplied to mode switching circuit 10.

Figure 5:
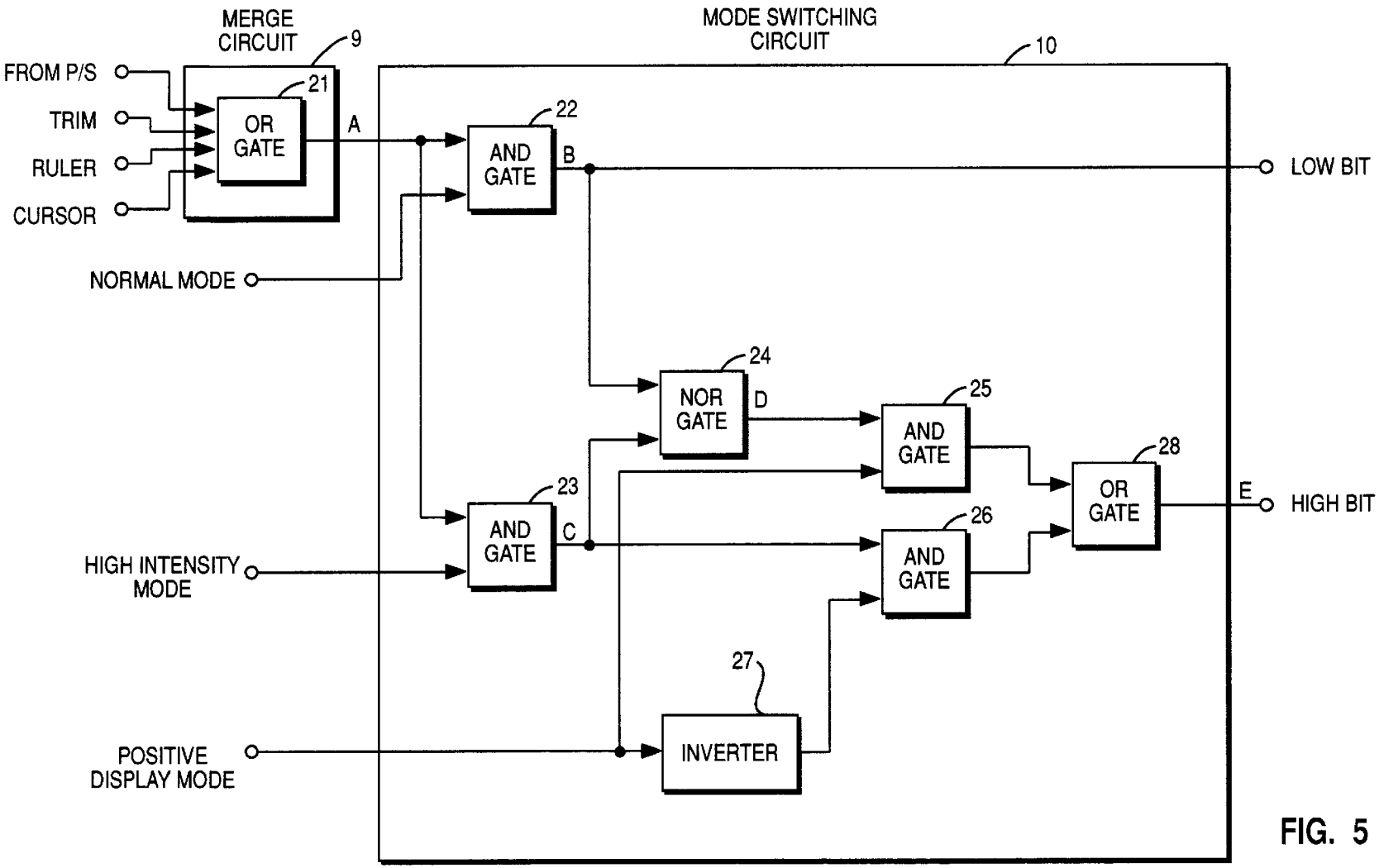
FIG. 5 is a block diagram of the mode switching circuit shown in FIG. 4.

The details of merge circuit 9 and mode switching circuit 10 are shown in FIG. 5. Merge circuit 9 includes an OR gate 21. The pixel pattern generated by font memory 7 is merged with a trim line, a ruler line or a cursor by OR gate 21. For illustrative purposes, it is assumed that a character T is displayed and the trim, ruler and cursor are not merged.

Mode switching circuit 10 includes AND gates 22, 23, 25 and 26, NOR gate 24, an inverter 27 and an OR gate 28. The character pixel patterns on one scan line of one row are sequentially supplied to OR gate 21. The output line of OR gate 21 is connected to one input of AND gates 22 and 23. The normal mode signal is applied to the other input of AND gate 22, the high intensity mode signal is supplied to the other input of AND gate 23, and the positive display mode signal is supplied to the input of inverter 27.

Two bits (high and low) are used to control the luminance of each pixel in the character box on the display screen, in the same manner as the prior art technology described above.

The luminance assigned to the two bit combination is as follows:

0 0 . . . Zero luminance (Black level)

0 1 . . . Low luminance (Gray level)

1 0 . . . High luminance (White level)

1 1 . . . Not used

The luminance assignment is the same as that in the prior art technology.

Output B of AND gate 22 is used as the low order bit of the two bit combination. Output B of AND gate 22 is also supplied to the one input of NOR gate 24. Output C of AND gate 23 is supplied to one input of AND gate 26 and the other input of NOR gate 24. Output D of NOR gate 24 is supplied to one input of AND gate 25. The positive display mode signal is also supplied to the other input of AND gate 25. The output of inverter 27 is supplied to the other input of AND gate 26. The outputs of AND gates 25 and 26 are supplied to OR gate 28. Output E of OR gate 28 is used as the high order bit of the two bit combination.

Figure 6A:
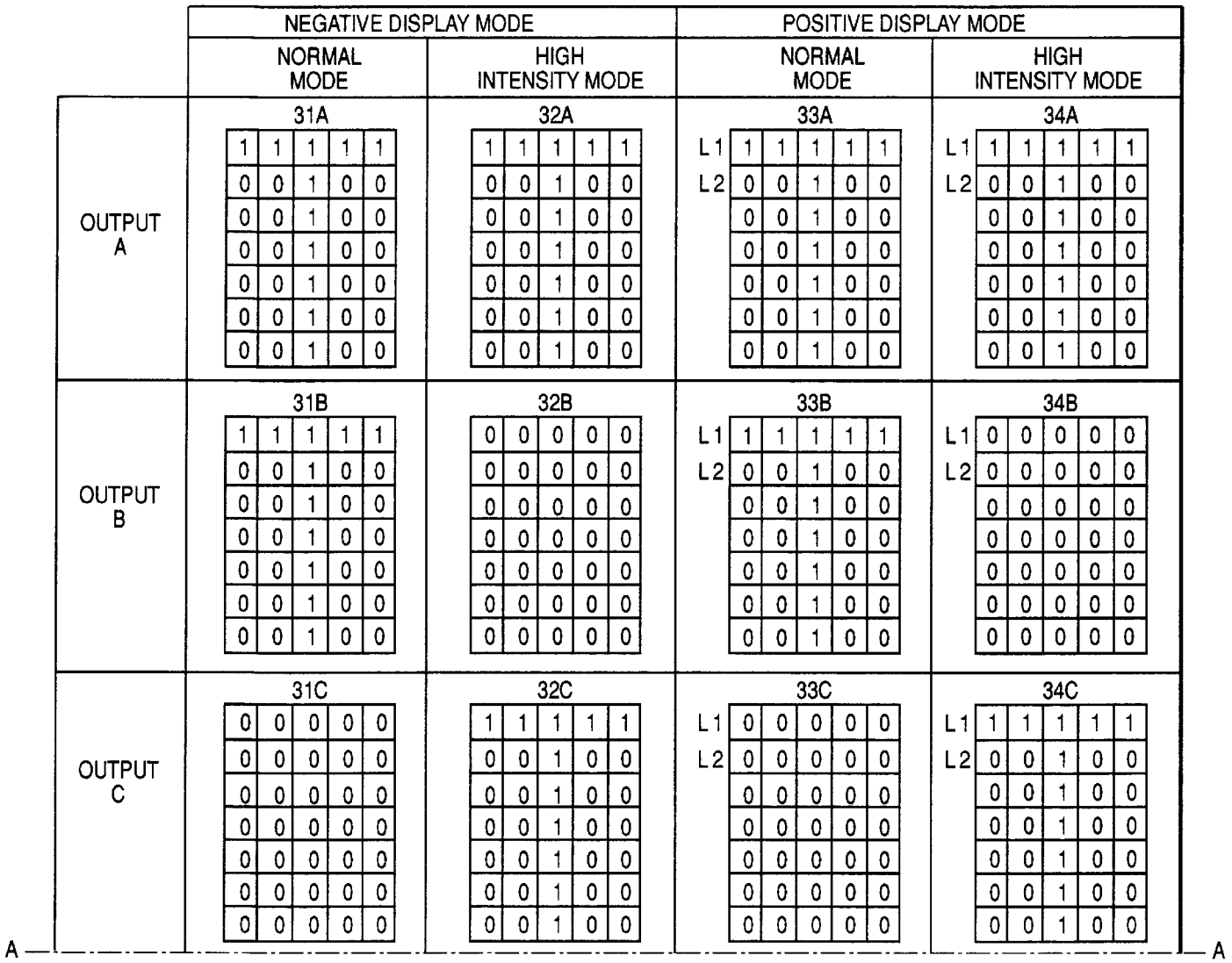
FIG. 6 shows various pixel patterns at various points of the circuit shown in FIG. 5.
Figure 6B:
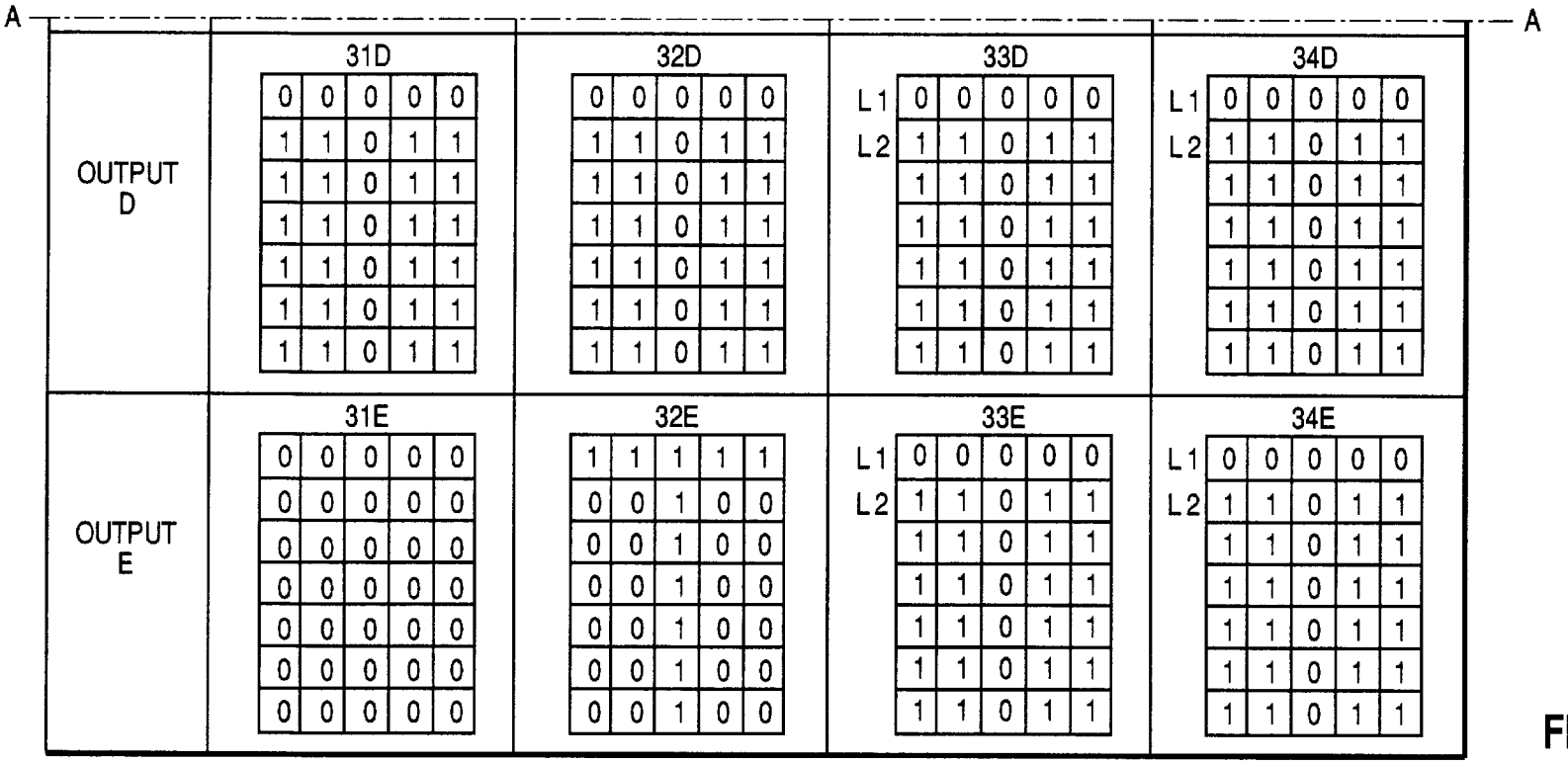

FIG. 6 shows the pixel patterns of the character T at outputs A, B, C, D and E of the circuit shown in FIG. 5 in various modes of operation. For example, pixel patterns 31A, 32A, 33A and 34A show the output bits at output A of merge circuit 9 in FIG. 5. These pixel patterns are supplied to mode switching circuit 10 as the input pixel pattern in the respective operational mode. In the pixel pattern received by mode switching circuit 10, the foreground pixels (i.e. image pixels of the character T) are represented by one binary number (i.e. the binary number 1), and the background pixels of the character T are represented by the other binary number (i.e. the binary number 0). The two bit combination for each pixel is then supplied to video circuit 11 which controls the intensity of the scanning beam of the CRT display device 12.

In the normal mode of the negative display mode, the normal mode signal is at a high level, and both the high intensity mode signal and positive mode signal are at a low level. As shown by pixel patterns 31E and 31B, the high order bit of the foreground portion of the image is 0, and the low order bit of the foreground portion of the image is 1. As a result, the foreground image is displayed by low luminance specified by the two bit combination (0 1). In addition, the high order bit and the low order bit of the background portion of the image are both 0. As a result, the background is displayed by zero luminance specified by the two bit combination (0 0).

In the high intensity mode of the negative display mode, the high intensity mode signal is at a high level, and both the normal mode signal and positive display mode signal are at a low level. As shown in pixel patterns 32E and 32B, the foreground image is displayed by high luminance specified by the two bit combination (1 0) and the background is displayed by zero luminance specified by the two bit combination (0 0).

Thus, the present invention provides the same luminance as the prior art in the negative display mode (as described above with respect to pixel patterns 71B, 71C, 72B and 72C in FIG. 2).

In the normal mode of the positive display mode, the normal mode signal and the positive display mode signals are at a high level, and the high intensity mode signal is at a low level. The pixel patterns at outputs A, B, C, D and E of FIG. 5 in this mode are shown by pixel patterns 33A, 33B, 33C, 33D and 33E of FIG. 6. As shown by pixel patterns 33E and 33B, the high order bit of the foreground portion of the image is 0 and the low order bit of the foreground portion of the image is 1. Thus, each pixel of the foreground image is displayed by low luminance or gray level specified by the two bit combination (0 1). In addition, the high order bit and the low order bit of the background portion of the image are 1 and 0, respectively. Thus, the background is displayed by high luminance specified by the two bit combination (1 0).

In the high intensity mode of the positive display mode, the normal mode signal is at a low level, and both the high intensity mode signal and the positive display mode signal are at a high level. As shown in pixel patterns 34E and 34B, the foreground image is displayed by zero luminance or black level specified by the two pixel combination (0 0) and the background is displayed by high luminance specified by the two bit combination (1 0).

It is noted that the background in both the normal and high intensity modes of the positive display mode is displayed by high luminance. However, the luminance of the foreground image is switched between the low luminance in the normal mode and the zero luminance in the high intensity mode.

Figures 7, 8:
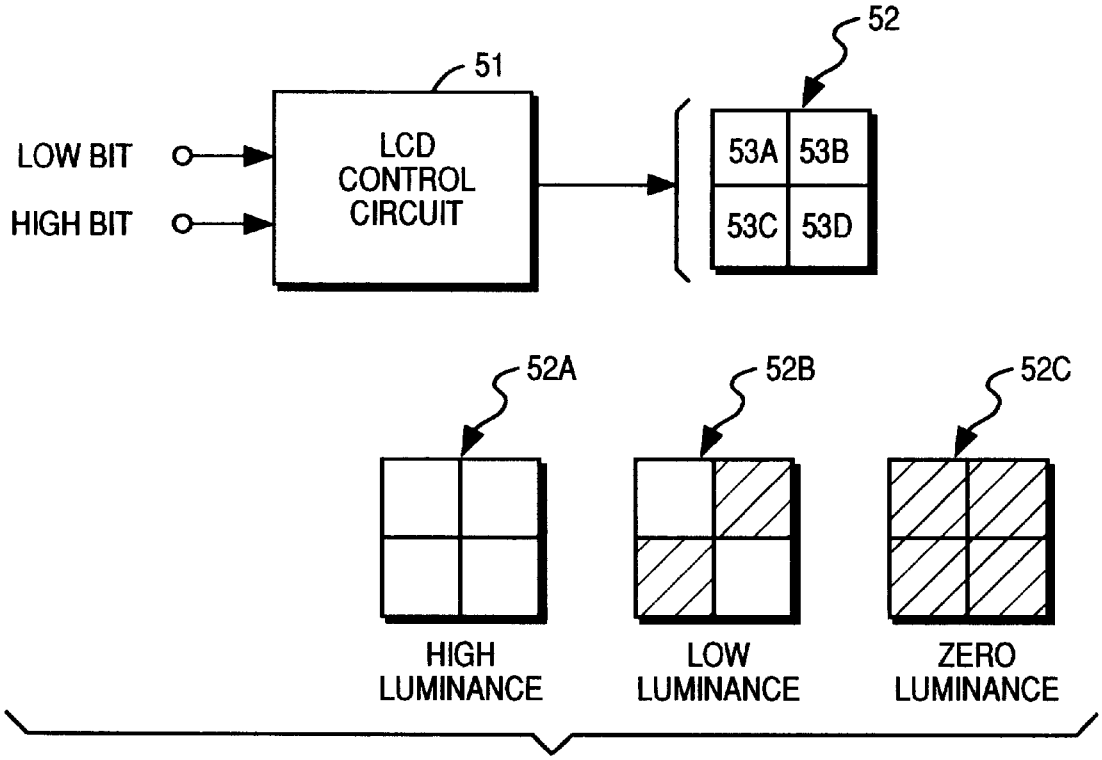
FIG. 7 shows an image displayed on a screen in accordance with the present invention.
FIG. 8 shows a second embodiment of the present invention.

FIG. 7 shows an example of a displayed image on the screen of CRT display device 12 in accordance with the present invention. This displayed image matches the displayed image described in FIG. 3 above. As in FIG. 3, the mark @ in FIG. 7 is the field attribute representing the high intensity mode, and the mark # is the field attribute representing the normal mode. It is again noted that neither of the marks @ and # are actually displayed on the display screen.

In FIG. 7, although both the normal and high intensity modes are displayed together, the I.uminance of the entire background is high intensity. This is different from the prior art technology wherein the background areas 82 and 83 are displayed by high luminance and background areas 84, 85 and 86 are displayed by low luminance. As a result of this difference, The present invention solves the problems of screen illegibility and the asthenopia or fatigue of the operator's eyes caused by prior art technology.

FIG. 8 shows a second embodiment wherein the concept of the present invention is used in a liquid crystal display (LCD). Pixel 52 corresponds to one pixel shown in FIG. 6. Pixel 52 includes plural LCD cells, such as LCD cells 53A, 53B, 53C and 53D. Each LCD cell is switched between the first state wherein the liquid crystal material is in an opaque state, and the second state wherein the liquid crystal material is in a transparent state.

The two bit combination for each pixel is applied to an LCD control circuit 51. When the two bit combination (1 0) is applied, LCD control circuit 51 generates a high luminance pixel 52A by switching all four LCD cells to the transparent state whereby light, such as from a backlight source, is transmitted through the four cells. When the two bit combination (0 1) is applied, LCD control circuit 51 generates a low luminance pixel 52B by switching two LCD cells to the transparent state and the other two LCD cells to the opaque state. When the two bit combination (0 0) is applied, LCD control circuit 51 generates a zero luminance pixel 52C by switching all four LCD cells to the opaque state.

The invention can also be used to control a plasma display device, an electroluminescence display device, a LED display device, etc. The luminance of the foreground and background pixels of a color display device can also be controlled in accordance with the invention.

While the invention has been described with reference to the illustrated embodiment, this description is not intended to be construed in a limiting sense. Various modifications of the illustrated embodiment as well as other embodiments of the invention will become apparent to those persons skilled in the art upon reference to this description. It is, therefore, contemplated that these appended claims will cover any such modifications or embodiments as fall within the true scope of this invention.

What is claimed is:

1. A device for generating pixel luminance signals corresponding to text to be displayed comprising:

a) means for selectively generating a normal mode signal for selected first text and a high intensity mode signal for highlighting selected second text concurrently displayed with said first text;

b) means for receiving an intensity signal specifying a first mode or a second mode; and c) means, coupled to the means for receiving, for generating background pixel luminance signals of a first luminance level and, in the first mode, for decreasing contrast while increasing overall luminance, relative to said second mode, of said first text by generating foreground pixel luminance signals of a second luminance level with less luminance than the first luminance level and, in the second mode, for increasing contrast while decreasing overall luminance of said second text to be highlighted by generating foreground pixel luminance signals of a third luminance level with less luminance than the second luminance level, whereby said first text in the first mode and said second text in the second mode are displayed concurrently.

2. The device of claim 1 further comprising:

means coupled to the means for generating, for receiving a display mode signal specifying a positive or negative display mode.

3. The device of claim 2 wherein the means for generating further comprises means, in the negative mode, for generating background pixel luminance signals of said third luminance level with less luminance than said second luminance level and, in the first mode and the negative mode, foreground pixel luminance signals of said second luminance level with less luminance than said first luminance level, and, in the second mode and the negative mode, for generating foreground pixel luminance signals of said first luminance level.

4. The device of claim 1 further comprising means for displaying pixels coupled to the means for generating pixel luinance signals.

5. The device of claim 4 wherein the means for displaying includes a CRT for displaying a white pixel in response to a pixel luminance signal of a first luminance level, a grey pixel in response to a pixel luminance signal representing a second luminance level, and a black pixel in response to a pixel luminance signal representing a third luminance level.

6. The device of claim 4 wherein the means for displaying includes a liquid crystal display for displaying a white pixel in response to a pixel luminance signal of a first luminance level, a grey pixel in response to a pixel luminance signal representing a second luminance level, and a black pixel in response to a pixel luminance signal representing a third luminance level.

7. The device of claim 6 wherein the liquid crystal display further comprises a plurality of cells for each pixel, the number of cells being turned on for each pixel depending upon the luminance level of the pixel luminance signal.

8. A device for generating a pixel luminance signal corresponding to text to be displayed comprising:

a) means for selectively generating an intensity signal specifying a first mode for selected first text or a second mode for highlighting selected second text concurrently displayed with said first text;

b) means for receiving a pixel signal specifying foreground or background;

c) means for receiving an intensity signal specifying a first mode or a second mode; and d) means, coupled to the means for receiving a pixel signal and the means for receiving an intensity signal, in response to a background pixel signal, for generating a first pixel luminance signal of a first luminance level, and in response to a foreground pixel signal, for decreasing contrast while increasing overall luminance, relative to said second mode, of said first text by generating a second pixel luminance signal of a second luminance level with less luminance than the first luminance level in a first mode, and for increasing contrast while decreasing overall luminance of said second text to be highlighted by generating a third pixel luminance signal of a third luminance level with less luminance than the second luminance level in a second mode, whereby said first text in the first mode and said second text in the second mode are displayed concurrently.

9. The device of claim 8 further comprising:

means, coupled to the means for generating, for receiving a display mode signal specifying a positive or negative display mode.

10. The device of claim 9 wherein the means for generating further comprises means, in the negative mode, for generating background pixel luminance signal of a third luminance level and, in the first mode and the negative mode, foreground pixel signals of a second luminance level, and, in the second mode and the negative mode, for generating foreground pixel signals of a first luminance level.

11. The device of claim 10 wherein the means for receiving an intensity signal comprises:

a) a first intensity means for receiving an intensity signal specifying the first mode; and b) a second intensity means For receiving an intensity signal specifying the second mode.

12. The device of claim 11 wherein the means for generating comprises:

a) a first AND gate having inputs coupled to the means for receiving a pixel signal and the first intensity means for receiving an intensity signal specifying a first mode;

b) a second AND gate having inputs coupled to the means for receiving a pixel signal and the second intensity means for receiving an intensity signal specifying a second mode;

c) a NOR gate having inputs coupled to the first and second AND gates;

d) an inverter having inputs coupled to the means for receiving a display mode signal;

e) a third AND gate having inputs coupled to the NOR gate and the means for receiving a display mode signal;

f) a fourth AND gate having inputs coupled to the second AND gate and the inverter; and g) an OR gate having inputs coupled to the third and fourth AND gates.

13. The device of claim 8 further comprising means for displaying pixels coupled to the means for generating pixel luminance signals.

14. The device of claim 13 wherein the means for displaying includes a CRT for displaying a white pixel in response to a pixel luminance signal of a first luminance level, a grey pixel in response to a pixel luminance signal representing a second luminance level, and a black pixel in response to a pixel luminance signal representing a third luminance level.

15. The device of claim 13 wherein the means for displaying includes a liquid crystal display for displaying a white pixel in response to a pixel luminance signal of a first luminance level, a grey pixel in response to a pixel luminance signal representing a second luminance level, and a black pixel in response to a pixel luminance signal representing a third luminance level.

16. The device of claim 15 wherein the liquid crystal display further comprises a plurality of cells for each displayed pixel, the number of cells being turned on for each pixel depending upon the luminance level of the pixel luminance signal.

17. A method of generating pixel luminance signals corresponding to text to be displayed comprising the steps of:

a) selectively generating an intensity signal specifying a first mode or a second mode;

b) receiving an intensity signal specifying a first mode for selected first text or a second mode for highlighting selected second text concurrently displayed with first text; and c) generating background pixel luminance signals of a first luminance level d) decreasing contrast while increasing overall luminance, relative to a second mode, of said first text by generating, in response to foreground pixel signals in the first mode, foreground pixel luminance signals of a second luminance level with less luminance than the first luminance level; and e) increasing contrast while decreasing overall luminance of said second text to be highlighted by generating, in response to foreground pixel signals in the second mode, foreground pixel luminance signals of a third luminance level with less luminance than the second luminance level, whereby said first text in the first mode and said second text in the second mode are displayed concurrently.

18. The method of claim 17 further comprising the step of:

receiving a display mode signal specifying a positive or negative display mode.

19. The method of claim 18 further comprising the steps of:

a) generating, in the negative mode, background pixel luminance signals of a third luminance level;

b) generating, in the first mode and the negative mode, foreground pixel luminance signals of a second luminance level; and c) generating, in the second mode and the negative mode, foreground pixel luminance signals of a first luminance level.

20. The method of claim 17 further comprising the step of: displaying pixels from the pixel luminance signals.

21. A method of generating a pixel luminance signal corresponding to text to be displayed comprising the steps of:

a) selectively generating an intensity signal specifying a first mode for selected first text or a second mode for highlighting selected second text concurrently displayed with first text;

b) receiving a pixel signal specifying foreground or background;

c) receiving an intensity signal specifying a first mode or a second mode; and d) generating, in response to a background pixel signal, a first pixel luminance signal of a first luminance level;

e) decreasing contrast while increasing overall luminance, relative to said second mode, of said first text by generating, in response to a foreground pixel signal in a first mode, a second pixel luminance signal of a second luminance level with less luminance than the first luminance level; and f) increasing contrast while decreasing overall luminance of said second text to be highlighted by generating, in response to a foreground pixel signal in a second mode, a third pixel luminance signal of a third luminance level with less luminance than the second luminance level, whereby said first text in the first mode and said second text in the second mode are displayed concurrently.

22. The method of claim 21 further comprising the step of:

receiving a display mode signal specifying a positive or negative display mode.

23. The method of claim 22 further comprising the steps of:

a) generating, in the negative mode, background pixel luminance signals of a third luminance level;

b) generating, in the first mode and the negative mode, foreground luminance pixel signals of a second luminance level; and c) generating, in the second mode and the negative mode, foreground luminance pixel signals of a first luminance level.

24. A device for displaying pixels corresponding to text to be displayed comprising:

a) means for receiving an intensity signal specifying a first mode for selected first text or a second mode for highlighting selected second text concurrently displayed with first text;

b) means for receiving an intensity signal specifying a first mode or a second mode;

c) means, coupled to the means for receiving, for generating background pixel luminance signals of a first luminance level and, in the first mode, for decreasing contrast while increasing overall luminance, relative to said second mode, of said first text by generating foreground pixel luminance signals of a second luminance level with less luminance than the first luminance level and, in the second mode, for increasing contrast while decreasing overall luminance of said second text to be highlighted by generating foreground pixel luminance signals of a third luminance level with less luminance than the second luminance level;

d) means for displaying pixels coupled to the means for generating pixel luminance signals; and e) processor means, coupled to the means for receiving, the means for generating and the means for displaying, for controlling the operations of the means for receiving, the means for generating and the means for displaying, whereby said first text in the first mode and said second text in the second mode are displayed concurrently.

* * * * *